US005956772A

United States Patent [19]

Widdemer

[11] Patent Number: 5,956,772

[45] Date of Patent: Sep. 28, 1999

[54] WATER PUMPING GLOVE OR SHOE

[75] Inventor: John D. Widdemer, Gloversville, N.Y.

[73] Assignee: Bali Leathers, Inc., Johnstown, N.Y.

[21] Appl. No.: 09/169,680

[22] Filed: Oct. 9, 1998

Related U.S. Application Data

[60] Provisional application No. 60/061,605, Oct. 10, 1997.

[51] Int. Cl.[6] ..... A41D 19/00; A43B 5/00

[52] U.S. Cl. ..... 2/167; 2/161.1; 36/98

[58] Field of Search ..... 2/159, 161.1, 161.7, 2/161.8, 161.3, 167, 169, 22, 161.6; 36/83, 113, 1, 114, 115, 3 R; 427/243, 245; 428/473

[56] References Cited

U.S. PATENT DOCUMENTS

| | | | |
|---|---|---|---|
| 4,073,072 | 2/1978 | Gross et al. | 36/44 |
| 4,808,188 | 2/1989 | Ledford et al. . | |
| 5,069,965 | 12/1991 | Esemplare | 2/168 |
| 5,093,379 | 3/1992 | Tiao et al. | 521/129 |
| 5,261,169 | 11/1993 | Williford | 36/43 |
| 5,354,815 | 10/1994 | Barringer, Jr. . | |
| 5,408,012 | 4/1995 | Barringer, Jr. . | |
| 5,459,880 | 10/1995 | Sakaki et al. | 2/168 |
| 5,511,323 | 4/1996 | Dahlgren | 36/3 A |
| 5,614,598 | 3/1997 | Barringer, Jr. . | |
| 5,620,773 | 4/1997 | Nash | 2/169 |
| 5,708,979 | 1/1998 | Redwood et al. | 2/167 |
| 5,727,336 | 3/1998 | Ogden | 36/43 |

*Primary Examiner*—Amy B. Vanatta
*Attorney, Agent, or Firm*—Aufrichtig Stein & Aufrichtig, P.C.

[57] ABSTRACT

A thermal regulating sports glove or shoe incorporating an electrostatic field within the fiber structure of the natural or synthetic leather, from which the glove or shoe is formed. The electrostatic field causes the water molecules in the wearer's perspiration to remain in a constant state of agitation thereby breaking down the bond of surface tension of the normal liquid state of water into free water molecules. Free water molecules are then pulled through the natural or synthetic leather by a magnetic process to the surface, where they pass into the air as evaporated water. This evaporation on the outer surface of the glove or shoe, which is now acting much as "second layer of skin", serves to regulate the temperature of the wearer's hand or foot almost as if the evaporation were taking place on the wearer's own skin surface.

3 Claims, No Drawings

WATER PUMPING GLOVE OR SHOE

This application claims benefit of Provisional Application Ser. No. 60/061,605 filed Oct. 10, 1997.

BACKGROUND OF THE INVENTION

The invention is generally directed to the design and comfort of sport gloves which are worn in warm or hot weather to enhance grip and, in particular, to sport gloves such as a golf glove which can pump water in the form of perspiration through a natural or synthetic leather away from the wearer's hand. It is also applicable to sport shoes. Currently, golfers, baseball batters, racquet sports players, bikers and other sports participants often wear grip enhancing gloves. In hot weather this can cause the wearer's hand to overheat and sweat, causing slippage in their grip, as well as causing distracting discomfort. In the past, attempts have been made to construct cooler gloves by using various open mesh fabrics or various types of hydrophilic (wicking) fabrics on the glove back. Although these methods provide partial relief, they cannot address the palm area (since such fabrics do not have gripping ability or suitable abrasion resistance) nor are they particularly effective since, for wicking action to continue, the wearer's perspiration rate must be fairly constant. In many sports the activity is sporadic and wicking action is, therefore, ineffective. A need exists for a sports glove which helps to maintain a temperature comfort level for the wearer's hand. The human body has a self-regulating mechanism to maintain a desirable temperature range, and an important part of this mechanism is the generating of sweat, which, by evaporating on the skin's surface, tends to cool the skin. In conventional gloves, most of this sweat is trapped between the glove and the wearer's skin or in the internal structure of the leather or fabric where, instead of evaporating, it forms a warming moisture barrier, contributing to uncomfortable temperature and poor grip. Accordingly, there is a need for an improved glove of natural and synthetic leather which incorporates an electrostatic field within the fiber structure of the natural or synthetic leather from which the glove is formed which will cause the water molecule in the wearer's perspiration to remain in a constant state of agitation thereby breaking down the bond of surface tension of the normal liquid state into free water molecules, which are then pulled through the natural or synthetic leather, by a magnetic process to the surface, where they pass into the air as evaporated water.

SUMMARY OF THE INVENTION

The invention is generally directed to a thermal regulating sports glove or shoe incorporating an electrostatic field within the fiber structure of the natural or synthetic leather, from which the glove or shoe is formed. The electrostatic field causes the water molecules in the wearer's perspiration to remain in a constant state of agitation thereby breaking down the bond of surface tension of the normal liquid state of water into free water molecules. Free water molecules are then pulled through the natural or synthetic leather by a magnetic process to the surface, where they pass into the air as evaporated water. This evaporation on the outer surface of the glove or shoe, which is now acting much as "second layer of skin", serves to regulate the temperature of the wearer's hand or foot almost as if the evaporation were taking place on the wearer's own skin surface.

The required electrostatic field is created through the introduction into the natural leather during its tanning or retanning process or into a synthetic leather glove or shoe during its manufacture process, of a chemical additive which molecularly alters the leather or synthetic leather fiber's fundamental chemical structure. The process creates a series of negatively charged functional groups containing a single negative charge, and interspersed between the single charged molecules are functional groups that contain two negative charges (a double negative charge), forming a series of chemical magnets for water (which is chemically a dipole with positive and negative ends). The water molecules, which have been separated through agitation caused by the electrostatic field, are pulled towards the doubly negatively charged groups and pushed towards the next singly negatively charged molecule. This causes the perspiration generated on the glove wearer's skin to be broken down and moved through the glove's fiber structure to its surface, where it evaporates, creating a cooling effect, both through evaporation and by reducing the pool of liquid which otherwise would be collecting against the wearer's hand and in the fiber structure of the glove.

In a currently preferred embodiment of the invention the chemical powder which helps to produce the required electrostatic field is a chemical produced by CHARBERT of 299 Church Street, Alton, R.I., which is currently used in polyester and nylon applications with the trade names "Akwatek" and "Akwadyne" and which is added in powder form while the fiber structure of the leather is opened and receptive during the tanning or retanning processes.

Accordingly, it is the object of the invention to provide an improved, more comfortable glove to be worn in hot weather which will transport perspiration moisture from against the wearer's hand through the natural or synthetic leather from which the glove is made to its surface where evaporation can take place.

Another object of the invention is to provide an improved, more comfortable glove to be worn in hot weather which will reduce the amount of moisture surrounding it's wearer's hand thereby improving his grip on a golf club, baseball bat, racquet, bike handle, bar bell or other sporting goods equipment or machinery.

Another object of the invention is to provide an improved natural or synthetic leather which pumps water through the natural or synthetic leather in use.

Yet a further object of the invention is to provide an improved sport glove incorporating an electrostatic and magnetic pump for breaking the water evaporated from a wearer's hand into individual water molecules and then magnetically pumping them through the natural or synthetic leather.

Still yet a further object of the invention is to provide an improved natural or synthetic leather which transports moisture by a chemical principle known as electrochemical transport.

Still a further object of the invention is to provide an improved golf glove which allows for water to be pumped from the palm side of the glove away from the wearer's hand.

Yet another object is to provide an improved leather or synthetic leather shoe which allows water to be pumped from inside the shoe to the outside away from the wearer's foot.

Still other objects and advantages of the invention will, in part, be obvious and will, in part, be apparent from the specification.

The invention accordingly comprises the features of construction, combinations of elements and arrangements of parts which will be exemplified in the construction as hereinafter set forth, and the scope of the invention will be indicated in the Claims.

DETAILED DESCRIPTION OF THE PREFERRED EMBODIMENT

The natural or synthetic leather which is utilized to form a sports glove, such as a golf glove or shoe, such as a golf shoe, is formed in accordance with standard manufacturing purposes except for the introduction of a chemical additive in the manufacturing process which creates the electrostatic force and magnetic pumping action on the water molecules.

In conventional leather making for use in golf gloves there is a two-step process utilized. Generally, there is a primary tanning, which is generally a chrome tanning in a preferred embodiment and a secondary tanning or retanning process which is used to incorporate additional materials into the matrix structure of the tanned leather so that desired characteristics are introduced. These characteristics can include strength, softness, flexibility or even color. Generally, in the tanning or retanning process the fiber or fibril network matrix of the natural leather swells and spaces are opened between the fibrils for molecules of different materials to enter the leather structure. Generally, as the retanning process is completed, the leather fibrils return to their tightened state and any materials added during the retanning process are then trapped, on a generally permanent basis, within the matrix of the leather. For example, graphite powder may be added, along with a synthetic tanning agent to chromium tanned leather in a retanning process to provide internal lubrication of the leather and a shock absorbing characteristic.

In this case, the Akwatek or Akwadyne chemical powder is generally added to the leather in connection with the retanning process. The chemical powders are preferably metal hydrides or complex metal hydrides such as lithium hydride or lithium aluminum hydride or other materials disclosed in U.S. Pat. No. 4,808,144 which is incorporated here by reference as if fully set forth. It is possible to introduce it in the primary tanning process but preferably the introduction is made during the retanning process after the primary tanning has been completed. Generally, in accordance with conventional leather tanning techniques, the chemical additive is added along with a synthetic tanning agent which "loosens" the structure of leather so as to provide openings in which the additive may enter the fiber structure of the leather. Thereafter, during a rinse step in the retanning process the excess syntan and powder is removed and the fiber structure of the leather again tightens trapping the additive within the fiber bundles and fibrils of the leather structure.

Alternatively, a surface addition approach can be used in which a material is added to the surface of the leather or synthetic leather. Preferably, the additive includes a polymerized hydrophilic polysiloxane having an affinity for the leather, of a type more fully described in U.S. Pat. Nos. 5,354,815, ; 5,614,598 and 5,408,012, which we incorporated herein by reference. Representative preferred materials which are polymerized include triethoxyvinyl silane, methyltrymethoxy silane, hexa-alkoxylated polysiloxane or a copolymer of a primary hydroxylate and a silane polymer having the formula $R'Si(OR'')_x$ where R' is an alkyl group, alkanyl group, aryl group, substituted alkyl or substituted alkenyl; R" is an alkyl; and x is greater than or equal to 3. The materials may also be sulfonated, phosphated, carboxylated or combinations of these modifications.

The chemical additive can also be included in a synthetic leather manufactured of polyester and polyurethane which has a polyester base with leather-like polyurethane add onto this. The material is added during the manufacturing process so as to create a similar electrostatic field and a series of negatively charged functional groups containing singly charged functional groups and interspersed between these singly charged molecules are functional groups that contain two negative charges which form a series of chemical magnets for the dipolar water molecules.

The natural and synthetic leather in accordance with the invention transports moisture by a chemical principle known as electrochemical transport. The process in which the chemical material is added to the natural or synthetic leather molecularly alters the leather or synthetic leather's fundamental chemical structure resulting in a permanent treatment that is independent of the garment construction. In other words, garments can be loose fitting or tight to the skin. The process also results in an improved hand and texture for the leather. The major benefit is that the resulting molecular alteration of the natural or synthetic leather creates a unique material that is self-adjusting to environmental and user demands and that acts as an extension of the natural thermal regulatory capacity in skin when worn as a glove or other garment. The leather responds to the exact thermal regulatory needs of the user because it is driven by the skin's rate of perspiration. Leather molecularly altered in accordance with the invention will cool the user during heat stress and warm the user during cold stress. Since the treated leather and synthetic leather take their directions from the skin, there is the capacity for regional thermal regulatory adjustment in different portions of the garment. This means that the leather can be cooling the user's body in one area and keeping it warm in another or more likely cooling at different rates in different areas.

The electrochemical moisture transport system is a consequence of chemically bonding a series of negatively charged molecules that extend off of the substrate of the fibers. The majority of these negatively charged functional groups contain a single negative charge. However, interspersed between these single charged molecules are functional groups that contain two negative charges. This chemical arrangement creates a series of chemical magnets for water from the single charged molecules with chemical pumps created as the result of the double charged molecules. The resulting system responds to the electrochemical properties of water.

Chemically, water is a dipole. This dipolar structure of water means that water has both positive and negative ends. The chemical magnets in the treated leather and synthetic leather attract water like magnets attract metal. The chemical pumping mechanisms pull water towards double negatively charged groups and then push it toward the next single negatively charged molecule. This electrochemical attraction means on a molecular level that the leather separates individual water molecules. The unique thermal regulation properties of this leather is based on this attraction and separation of individual water molecules. It is this chemical attraction and separation that makes gloves manufactured in accordance with the invention superior to other natural and synthetic materials that are currently available.

Most of the so-called thermal regulatory fabrics work either because the fabric is constituted with capillary channels built in or are chemically coated to create capillary (hydrophilic) channels. Moisture transported by capillary action requires that the fabric be in constant and continual contact with the body so that the capillary draw can be established and maintained.

The capillary cooling theory is based on the principle that if you spread water out thin enough this will facilitate its evaporation. The physical principle of moving water via capillary action has several severe limitations. First, since moving water by capillary action requires that the fabric be in constant contact with the body, any time the fabric moves away from the body the capillary movement of the water is arrested. These channels can also become clogged by detergents, dirt, oils or other substances found on a wearer's skin that would dramatically limit moisture transport over time. Further, this need for contact limits garment design. Next, transport of water by capillary action has limited thermal benefits.

Fabrics can be made to hold water and to keep the user relatively warmer or release water and keep the wearer relatively cooler but cannot respond to the precise needs of the wearer. Additionally, the cooling action of these fabrics is severely limited by environmental conditions. In order for water to cool the body it must evaporate. Spreading water out does not insure its evaporation. The analogy here is like washing the kitchen floor. There is a lag time until the floor completely dries. The higher the relative humidity the longer it takes the floor to dry. Thus, at high humidities, conditions often experienced in the summer, the capillary based fabrics lose their cooling effect and become a thermal burden by holding water and insulating the wearer, trapping heat next to the body.

The natural and synthetic leathers produced in accordance with the invention are superior for use in garments because they chemically, not physically, respond to transport moisture. The treated leather and synthetic leather electrochemically attracts individual water molecules, separating the water molecules from each other. This is important because water has high cohesive/coligative properties. Mercury is the only liquid that has higher cohesive/coligative properties than water. This means that the water wants to remain in liquid state and thus, resists evaporation. Water wants to remain as a liquid and not evaporate into a gas. By separating individual water molecules, evaporative forces now exceed cohesive/coligative forces and evaporation is favored. On a molecular level the negatively charged groups hold individual water molecules and resist releasing them until an additional water molecule is available to replace the current electrochemically bonded water molecule. It is because of this principle that the treated natural and synthetic leather can cool, warm and regionally thermal regulate.

In the winter, external environmental conditions are usually cold with low humidities. (Cold air holds less total moisture than warm air.) Under these conditions the treated natural or synthetic leather traps a molecular layer of water in the fabric that establishes a thermal barrier and an effective insulating layer. This barrier slows the rate of transfer of moisture to the environment. The trapped air next to the skin rapidly reaches 100% relative humidity, creating an air/water insulating layer next to the user's skin. This further increases the thermal benefit of the treated natural or synthetic leather. The air and water mixtures hold more total heat. (This why humidifiers are added to furnaces, this effect increases the heat capacity of the air.)

Garments manufactured from treated natural or synthetic leathers can be constructed out of lighter weight and thinner materials than conventional thermal regulatory clothing because the insulating capacity is created at the molecular level and is not a function of the thickness of the leather or fabric. Furthermore, the treated garments constructed in accordance with the invention dramatically reduce moisture accumulation next to the skin. As perspiration is produced, a new molecule of water replaces one currently held in the fabric, which is then lost to the environment. The rate of perspiration drives the exchange of water transferred to the environment and the effectiveness of the thermal barrier. This concept is also the basis for regional thermal regulatory adjustment.

Regional thermal regulatory adjustment (which is the fashion in which one area of the garment can be cooled while another area is kept warm), is molecularly based on the perspiration rate. Moisture transport through the natural or synthetic leather is driven by water replacement. In areas of the body that are cool, the negative charged groups hold water and create the thermal benefit described above. In areas that heat is being generated and, thus, perspiration is increasing, the treated leather increases evaporative water loss and cools the body. Thus, the treated leather in accordance with the invention does exactly what the wearer needs because it is body activated rather than pre-set.

The capabilities of the natural and synthetic leather manufactured in accordance with the invention and utilized in a glove or other garment are similarly driven by perspiration rates. As the wearer becomes heated and produces sweat the treated fabric responds by increasing evaporative transfer of moisture. The efficient evaporative cooling effect of the treated leather means that the wearer has to perspire less. This is because the available perspiration is used more effectively. Wearers of gloves or other garments made from the treated leather benefit from a double evaporative cooling effect. Some moisture evaporates once from the skin to the fabric and a second time from the fabric to the environment. Capillary transport can only evaporate moisture once and any sweat that rolls off the body represents a waste of thermal regulatory effort. Perspiration can only cool if it evaporates. Sweat that doesn't evaporate contributes to the total stress. The treated leather efficiently and electrochemically captures moisture insuring that thermal regulatory efficiency is maximized. This means that the individual saves energy and that energy can then be used to increase work or sport performance.

The only limitations on the operation of the natural or synthetic leather treated with the chemical additive which creates the electrostatic and magnetic forces related to the water are environmental conditions where the relative humidity approaches 100%. At 100% relative humidity all moisture evaporation is completely arrested and the fabric would lose its thermal efficiency. This limitation is true for all moisture transport fabrics. Notwithstanding this, the advantage is still with the treated natural or synthetic leather because it would be effective over a wider range of temperatures and humidities than other materials.

The treated natural or synthetic leather provides self-adjusting comfort under warm conditions. The more perspiration the body produces the more the leather bleeds out the moisture to the air as free water molecules or as moisture to evaporate. When activity slows or stops and the body cools, less perspiration is generated by the skin and the leather adjusts its rate of water pumping accordingly, keeping the wearer cool, calm, dry and comfortable.

Accordingly, an improved natural or synthetic leather which acts as a water pumping layer which can be formed into garments such as sport gloves or other skin contacting garments is provided. The natural or synthetic leather which is treated in accordance with the invention creates an electrostatic charge which acts to break up the water into individual molecules which are then attracted and pumped through the leather by the magnetic interrelationship between the charged particles added to the matrix of the leather and the dipolar water molecule.

Accordingly, it will thus be seen that the objects set forth above, among those made apparent from the preceding description are efficiently attained and, since certain changes may be made in the above constructions without departing from the spirit and scope of the invention, it is intended that all of the matter contained in the above description or shown in the accompanying drawings, shall be interpreted as illustrative, and not as limiting.

It is also to be understood that the following claims are intended to cover all of the generic and specific features of the invention, herein described and all statements of the scope of the invention which, as a matter of language, might be said to fall therebetween.

What is claimed is:

1. A glove or shoe, comprising:

tanned leather; and pumping means bonded to the leather in a tanning process, including a multiplicity of singly and doubly negatively charged particles distributed throughout the leather in connection with a tanning process, the pumping means including a metal hydride or complex metal hydride;

whereby the leather pumps water from the interior of the glove or shoe to the exterior of the glove or shoe by electrochemical means.

2. A glove or shoe, comprising:

a synthetic leather formed into a glove or shoe, the synthetic leather including in its internal structure a chemical additive which provides a multiplicity of singly and doubly negatively charged groups, the singly and doubly negatively charged groups interspersed throughout the synthetic leather, the chemical additive including a metal hydride or complex metal hydride;

whereby the singly and doubly negatively charged groups in the synthetic leather pump water by electrochemical means through the synthetic leather from the inside of the glove or shoe to the outside of the glove or shoe by electrochemical means.

3. A glove or shoe, comprising:

tanned leather or a synthetic leather formed into a glove or shoe; and water pumping means added to the tanned leather or synthetic leather for pumping water from the interior of the glove or shoe to the exterior of the glove or shoe by electrochemical means, the water pumping means including a polymerized hydrophilic polysiloxane.

* * * * *